United States Patent [19]

Edixhoven

[11] 4,430,916

[45] Feb. 14, 1984

[54] APPARATUS FOR MAKING SLATS FOR A SLATTED BLIND

[75] Inventor: Gerardus H. Edixhoven, Voorschoten, Netherlands

[73] Assignee: Hunter Douglas International N.V., Curacao, Netherlands Antilles

[21] Appl. No.: 275,676

[22] Filed: Jun. 22, 1981

[30] Foreign Application Priority Data

Aug. 2, 1980 [DE] Fed. Rep. of Germany ..... 3029456

[51] Int. Cl.[3] ..... B21D 45/02

[52] U.S. Cl. ..... 83/159; 198/598; 198/739; 414/748

[58] Field of Search ..... 83/159, 158; 198/598, 198/739; 414/748

[56] References Cited

U.S. PATENT DOCUMENTS

| | | | |
|---|---|---|---|
| 148,626 | 3/1874 | Reynolds et al. | 83/135 X |
| 482,917 | 9/1892 | Dix | 83/159 |
| 616,866 | 2/1899 | Greenwood | 83/135 |
| 944,972 | 12/1909 | Simpson | 83/159 |
| 1,975,155 | 10/1934 | Keller | 83/159 X |
| 2,569,197 | 9/1951 | Royer | 83/159 |
| 3,515,021 | 6/1970 | Walus et al. | 83/159 X |

*Primary Examiner*—James M. Meister

*Attorney, Agent, or Firm*—Pennie & Edmonds

[57] ABSTRACT

An ejection device for ejecting finished slats from apparatus for making slats for a slatted blind, which apparatus has a discharge table with associated stamping and cutting stations, comprises a pivotable arm to engage the slats remote from its pivot point and to be pivoted by an actuating member, which preferably includes some resilient means, in such a way that its initially acceleration is kept low so that upon initial engagement the slats are not damaged.

10 Claims, 10 Drawing Figures

APPARATUS FOR MAKING SLATS FOR A SLATTED BLIND

DESCRIPTION

The invention relates to an apparatus for making slats for a slatted blind.

One known form of such apparatus includes drivable stamping and cutting and/or assembly stations associated with a discharge table to which strip material is fed from a roll via a guide channel.

In the use of many embodiments of apparatus of this type, each finished slat is removed by hand from the discharge table. Although it is known to provide such apparatus with an ejecting device for removing finished slats after the machining has been completed, it has been found that at high production speeds and with correspondingly short work cycles, there is a danger, particularly with slats of a relatively small width and/or thickness, that the slats will be damaged by the ejecting device. Also, the technical and capital outlay involved with such ejecting devices, and the space they require, present disadvantages.

The object of the invention is, therefore, to provide a simple and reliable ejecting device capable of handling even narrow and light-weight slats without damage.

According to the present invention there is provided apparatus for making slats for a slatted blind including a discharge table for receiving strip material and stamping and cutting stations associated with said discharge table, and a device for ejecting finished slats from said discharge table, said ejecting device including an arm pivotable about an axis transverse to the intended direction of ejection, said arm being adapted to engage a finished slat, and an actuating member to rotate with a rotating shaft and, in part of its cycle of rotation, to engage said arm and urge said arm in said intended direction of ejection, said actuating member being adapted to provide sufficiently low initial acceleration of said arm in said direction to prevent damage to said slats.

With the invention, the pivoting arm which engages and ejects the slat after it has been finished is not accelerated abruptly. It is driven so that its increase in speed, at least in the first part of its ejecting movement, does not reach a value which could be harmful to the slats. In this way, satisfactory ejection of the slats can be better obtained even at high production speeds and correspondingly short work cycles. The technical and capital outlay required for this purpose is small, since the ejecting device need not require its own drive and associated control but can and preferably does run from the normal drive shaft of the apparatus. Thus it can be designed and arranged in a very space-saving way.

The initial period of arm movement, within which the increase in speed remains limited, normally extends up to the moment when the pivoting arm contacts the slat to be ejected. The extent to which limitation of the increase in speed is subsequently necessary depends on each particular case and, among other factors, the moment at which the slat is to be released or can be released from the stamping and cutting device.

Preferably, the actuating member includes resilient means through which it engages the arm so that the initial acceleration of the ejecting movement can be limited in an advantageous way. The acceleration in the first part of the ejecting movement can be predetermined or limited as a result of a suitable selection of the spring force while the provision of a spring means that the speed of the ejecting movement will usually increase over the greater part of pivotting of the arm after contact with the slat.

According to one preferred form of the invention the actuating member comprises a resilient actuating lever which is connected at one end to said shaft, or a disc mounted thereon, and is substantially tangential to the shaft or disc. This makes it possible to make the length of the actuating lever shorter if desired, depending on the diameter of the disc. The actuating lever can be made, for example, of a simple piece of spring wire, which is bent at its end over a length corresponding to the thickness of the pivotting arm.

In another embodiment, said actuating member comprises a cam on said shaft, a stop part in said cam which is movable radially therein with respect to said shaft, and a spring urging said stop part radially outwardly. In this case, when the stop part comes in contact with the pivotting arm, it first yields resiliently inwardly and later is urged out again to accelerate the arm. The stop part can be formed, for example, by a pin appropriately held and guided in the cam.

Preferably, the pivot axis of the pivotting arm is located above the drive shaft and the pivotting arm extends downwards, past the drive shaft on the side of the intended ejection direction to a position at which the machined slat is positioned. The arm suitably has a lower portion which extends approximately horizontally when the arm is in the position of rest and which is provided on its underside with a recess engaging over the slat. This provides a simple construction of the pivotting arm and a favourable interaction with the actuating member.

In accordance with another preferred embodiment, said actuating member comprises a bearing body on said shaft, a stop body pivotally mounted on said bearing body on an axis eccentric to said shaft, and a spring urging said stop body to a radially outward rotational position relative to said bearing body. In this embodiment, when the top body comes in contact with the pivotting arm, it is possible to prevent too abrupt a deflection of the pivotting arm, because the stop body rotates on the bearing body away therefrom to an extent determined by the spring. The kinetic energy thus stored in the spring is available, at a later time, for further acceleration of the arm.

Preferably, the spring is a flexible tension spring which is fastened at one end to the periphery of the bearing body and at the other end to the periphery of the stop body. It passes radially outward of the pivot axis of the stop body on the bearing body. With increasing tension in the spring, its point of contact with the stop body moves round to a smaller radius and the stop body rotates correspondingly.

Preferably the stop body is approximately in the form of a segment of a circle and the end of the spring extends approximately tangentially to its periphery and that of the bearing body. An essentially continuous transition between the bearing body, the spring and the stop body is obtained as a result. Furthermore, the bearing body is preferably cut out in the region of the stop body and forms an edge limiting the inward rotary movement of the stop body.

Preferably, in all embodiments, the inner side of the pivotting arm facing the drive shaft has a concavely curved shape where it is acted on by the actuating member. Preferably also there is, above the drive shaft, a restoring spring which urges the pivotting arm towards a stop against the action of the actuating member.

Due to the preferred concavely curved shape of the inner side of the pivotting arm, control of its rotary movement can be achieved in an advantageous way, and this shape also contributes to the fact that the speed of the pivotting arm can be arranged to increase in the final phase of the ejecting movement.

The restoring spring can guarantees a rapid return of the pivotting arm after the slat has been ejected. In cases where the stop is adjustable, the position of rest of the pivotting arm can be arranged according to the slat width. Since the restoring spring preferably engages on the pivotting arm relatively near the pivot axis, a relatively short spring deflection is sufficient.

The bearing body and if appropriate, the actuating cam as well can advantageously be integral parts of an eccentric driving sleeve which is attached to the drive shaft by which the stations are powered and is associated with an adjacent station. Manufacture and assembly can be simplified as a result.

In order that the invention may be more clearly understood, the following description is given by way of example only with reference to the accompanying drawings, in which.

Figure 1:
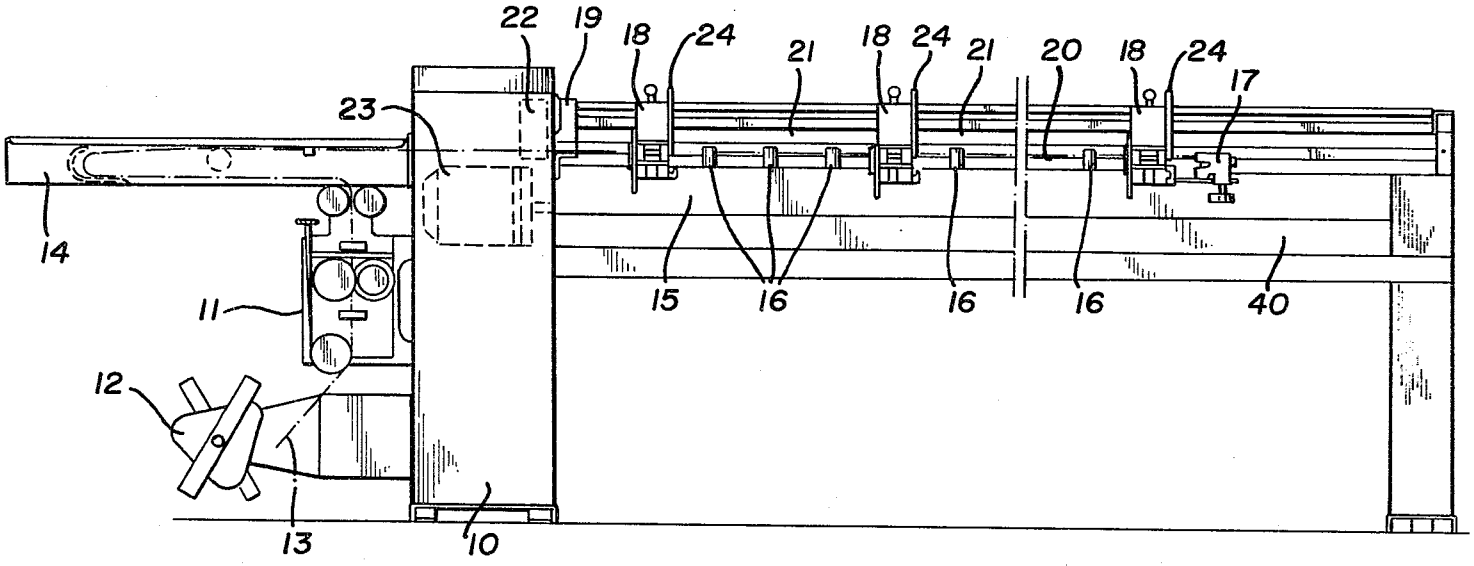
FIG. 1 shows, in side view, an overall apparatus for making slats.
Figure 2:
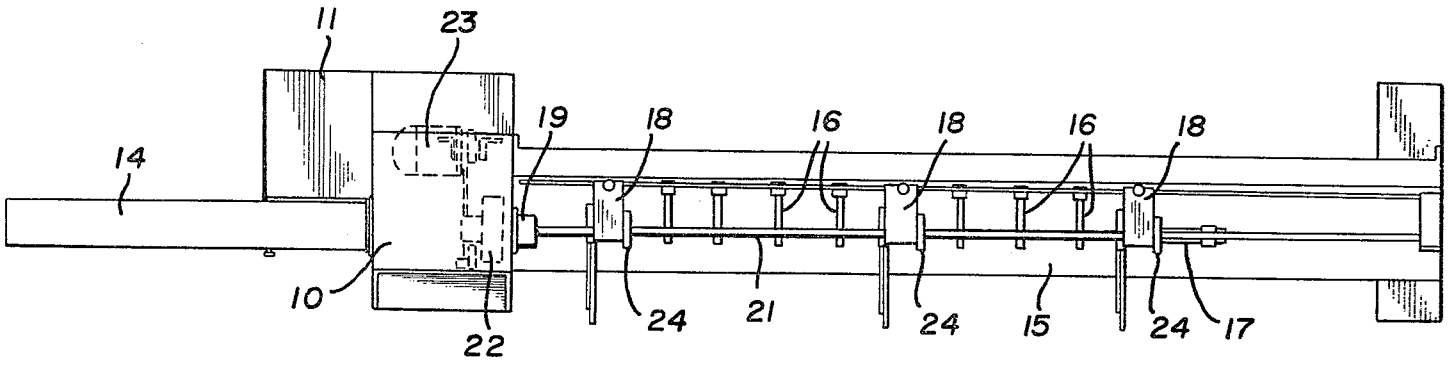
FIG. 2 shows a plan view of the apparatus shown in FIG. 1.

The general construction of the apparatus for making slats will first be described, with reference to FIGS. 1 and 2.

The apparatus includes a machine table 10, at the left end of which, as shown, is a drive and feed part 11, by means of which a strip of material 13 is drawn off a roll 12. The strip 13 normally consists of thin aluminum sheeting and has a cross-section corresponding to that of the slats to be made. The strip 13 is conveyed through a guide channel 14 onto a discharge table 15. Within the guide channel 14 the strip 13 forms a loop, so that a sufficient length of the strip is always available in the guide channel 14 to be forwarded to the discharge table 15 in a length corresponding to the length of one slat. The strip 13 is guided along the discharge table 15 between a plurality of pairs of guide bars 16. An adjustable stop 17 arrests the advancing strip and causes the necessary machining operations to be initiated. Above and spaced along the discharge table 15 are machining stations 18 which stamp the necessary holes or other shapes into the strip of material 13, while a further machining station 19, adjacent the machine table 10, severs a finished slat 20 from the strip of material 13 allowing the process to be repeated.

The machining stations 18 and 19 are actuated by a common drive shaft 21, which is driven via a clutch 22 by an electric motor 23 both of which are accommodated in the machine table 10. Normally, one revolution of the drive shaft 21 corresponds to one work cycle of the apparatus, in which one slat is finished.

According to the invention, a finished slat 20 is ejected from the discharge table by means of ejecting devices 24 one of which is located beside each machining station 18. A first embodiment of ejecting device 24 will now be described with reference to FIGS. 3 and 4.

Located between two parallel plates 25 is a pivoted arm 26 which is held at its top end on a pivot axis 27. The pivot axis 27 is held at each end in a plate 25 and it is located above the previously mentioned drive shaft 21 for the machining stations. Each pivotting arm 26 extends downwards on that side of the drive shaft 21 towards which ejection takes place. It will be appreciated that ejection is transverse to the longitudinal axis of the finished slat. Each pivotting arm 26 has at its lower end, a portion 28 designed to extend approximately horixontally when the arm is in a position of rest. The underside of the portion 28 is provided with a recess 29, which allows the pivotting arm 26 to engage over a slat 20 lying on the lower bars of the pairs 16, or a strip material 13 about to be formed into such a slat.

Closely below the pivot axis 27, one end of a restoring spring 30 engages the arm 26 the other end of the spring being held by means of a screw 31 on a side part 32 located and defining the distance between the plates 25. Provided in the lower region of the side part 32 is a stop 33, for example in the form of a setscrew, against which the lower portion 28 of the pivotting arm 26 can abut as a result of the action of the restoring spring 30.

Figure 3:
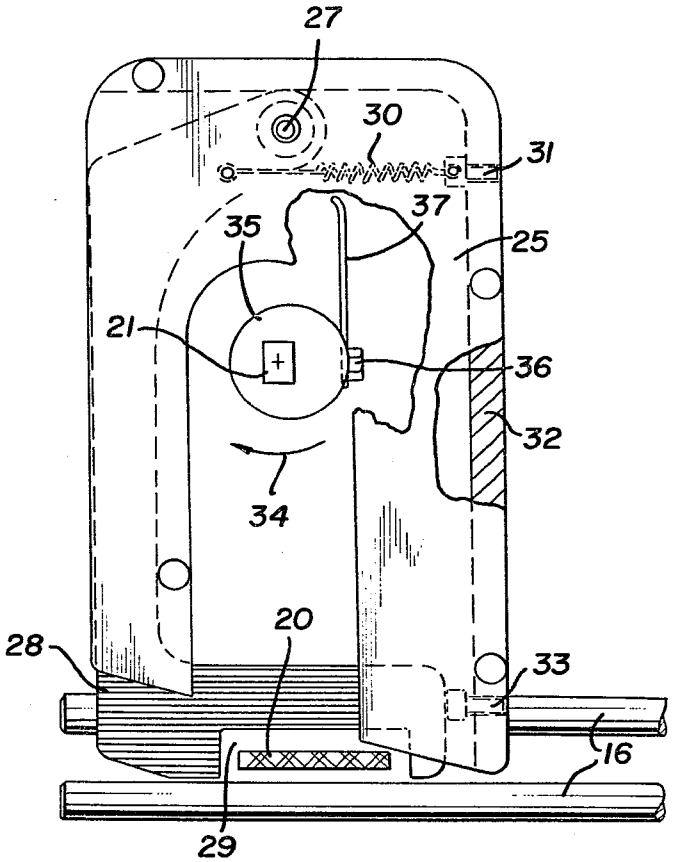
FIG. 3 shows, on an enlarged scale, a first device for ejecting a slat, in the position of rest of the pivotting arm thereof.

As previously mentioned the drive shaft 21 rotates through one revolution, in the direction indicated by an arrow 34, during each working cycle. An eccentric disc 35 is attached to the drive shaft 21 at each machining station 18. Fastened on the periphery of the disc 21 by means of a screw 36 is an actuating lever 37 which initially extends approximately tangentially to the disc. FIG. 3 shows the inoperative position of the lever 37 which occurs at the beginning and end of the working cycle of one revolution of the drive shaft 21. The actuating lever 37 consists of a suitable spring wire which is bent slightly at its free end in a direction opposite to the direction of rotation of the shaft 21. The very end can be bent in a direction perpendicular to the drawing plane of FIGS. 3 and 4, in order to achieve a greater contact area on the pivotting arm 26. In the region of the screw 36, the peripheral face of the disc 35 can be flattened. During a working cycle, the actuating lever 37 rotates with the drive shaft 21 and the disc 35 in the direction indicated by the arrow 34.

When the apparatus described with reference to FIGS. 1 to 4 is in operation, each work cycle is initiated by the end stop 17 being contacted by strip 13. This actuates the clutch 22 and, consequently, connects the drive shaft 21 to the electric motor 23 which is constantly running. Approximately 270°–300° of the work cycle is required for the actual machining of the slat 20 and for cutting the latter from the strip of material 13.

Figure 4:
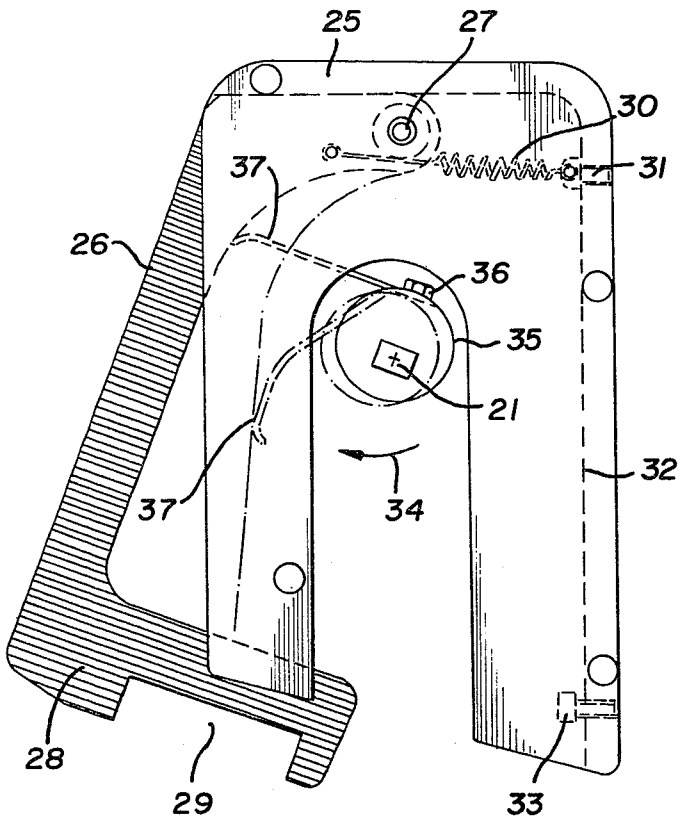
FIG. 4 shows the device of FIG. 3, in the ejecting position of the pivotting arm.

FIG. 3 suggests how, during this first part of the rotary movement, the actuating lever 37 does not deflect the pivotting arm out of its position of rest in which it is held by the spring 30 against the stop 33. In the last part of the cycle, however, the actuating lever 37 comes in contact with the inner side of the pivotting arm 26, and it yields and bends resiliently, but as the actuating lever 37 slides along and up the inner side of the pivotting arm 26, the pivotting arm 26 is brought into the position illustrated in FIG. 4. Of course, during this movement, the pivotting arm 26 pushes the finished slat 20 away from the pairs of bars 16 and urges it into a collecting trough 30 (FIG. 1). In the very last part of the working cycle, the actuating lever 37 allows the pivotting arm 36 to return to its position of rest, under the action of the restoring spring 30. The resilient yielding and bending of the actuating lever is represented in FIG. 4 by a dot-and-dash line. A consequence of this arrangement is that the acceleration pattern of pivotting of the arm 26 can be closely selected, particularly in that initial acceleration can be kept below a determined value to avoid damaging the slats.

Figure 5:
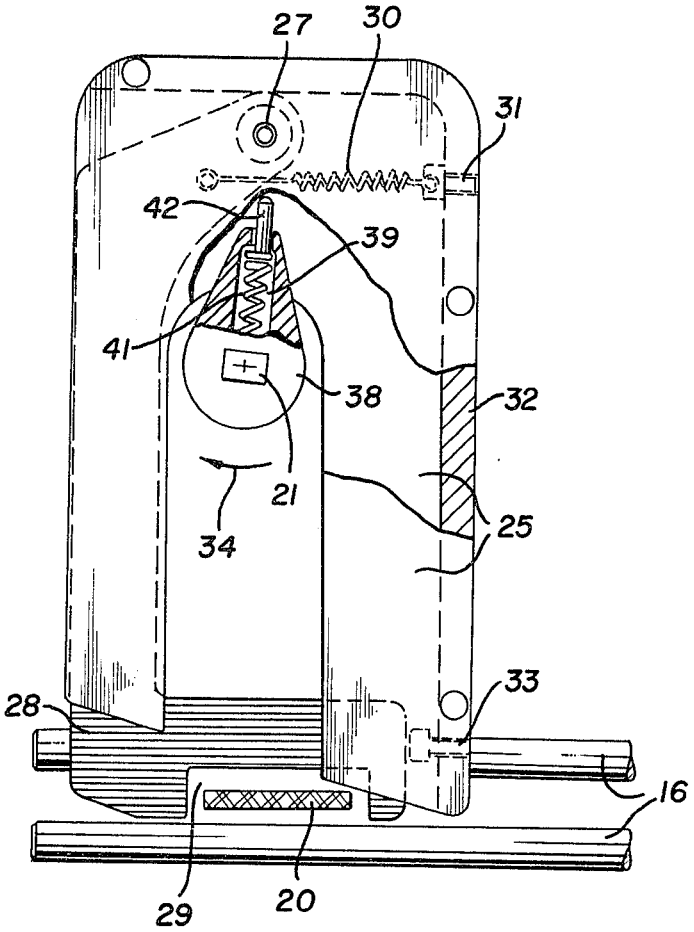
FIG. 5 shows, on a scale enlarged in comprison with FIGS. 1 and 2, a second, modified, embodiment of device for ejecting a slat, in the position of rest of the pivotting arm.

A second embodiment of the ejection apparatus is shown in and will be described with reference to FIGS. 5 to 7, where like parts are indicated with like reference numerals.

The only point of difference from the preceding embodiment is the provision of an actuating cam 38 attached to the drive shaft 21. This cam is provided with an interior bore 39, in which a radially aligned compression spring 41 is, at its inner end, in contact with the drive shaft 21, or a stop near to it. A stop pin 42 provided with an enlarged head contacts the other end of the compression spring 41 and is urged outwards so that the head of the stop pin 42 prevents it from leaving the bore 39. However, the stop pin 42 can be displaced into the bore 39, against the effect of the compression spring 41.

Figure 6:
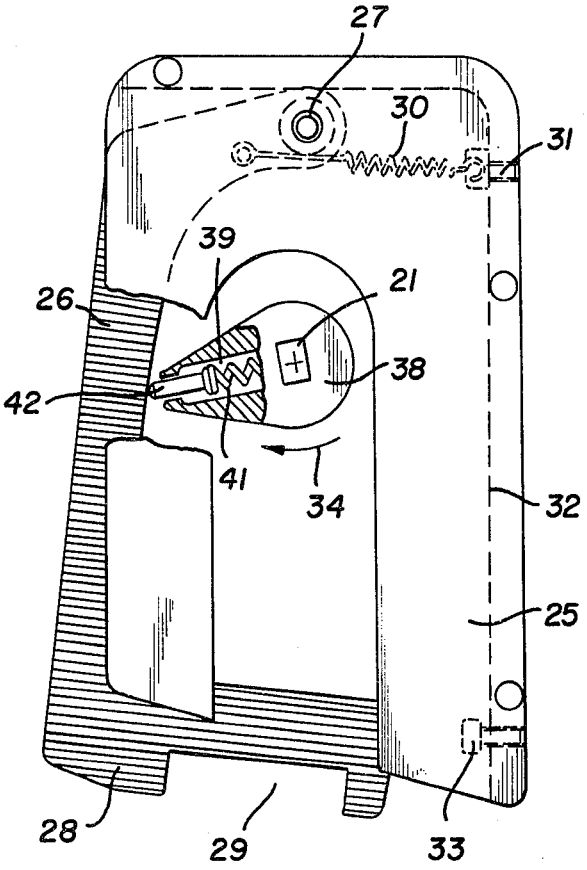
FIG. 6 shows the device of FIG. 5, in a position with the pivotting arm between the position of rest and the ejecting position.
Figure 7:
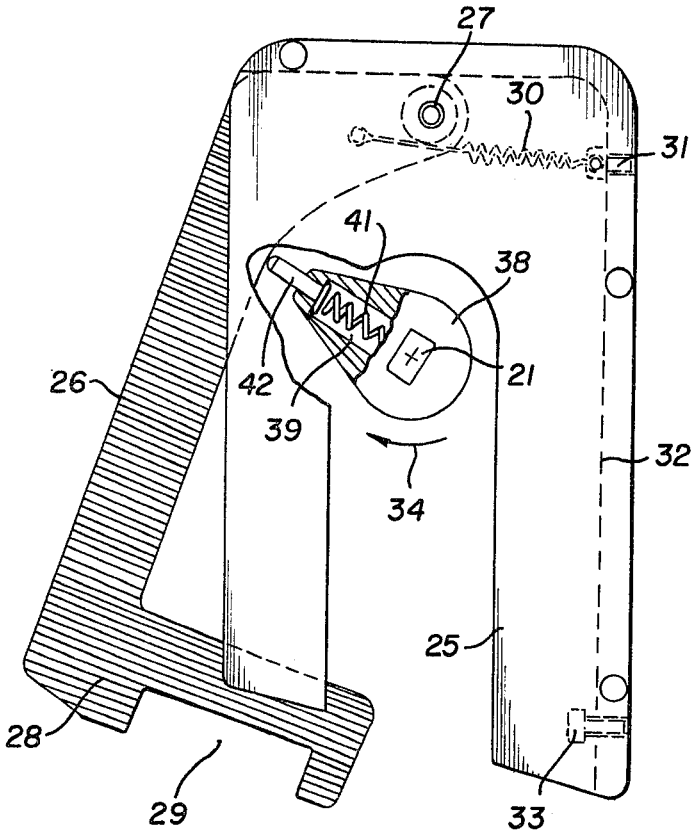
FIG. 7 shows the same device in the ejecting position of the pivotting arm.

It can be seen that, in a like manner to the actuating lever 37 of the preceding embodiment, the stop pin 42 contacts the inner side of the pivotting arm 26, approximately after 270° to 300° of a work cycle has elapsed, and is pushed a little way into the bore 39, as illustrated in FIG. 6. Because the stop pin rotates with the cam 38, however, the pivotting arm 26 is then swung outwards. The arrangement ensures that the initial acceleration of the pivotting arm 26 remains limited to a predetermined value, while in the course of further deflection of the pivotting arm 26, the stop pin 42 is displaced a little way outwards again by the compression spring 41 and this assists in accelerating the ejecting movement as does the movement of the point of contact of the pin 42 towards the pivot point 27.

Figure 8:
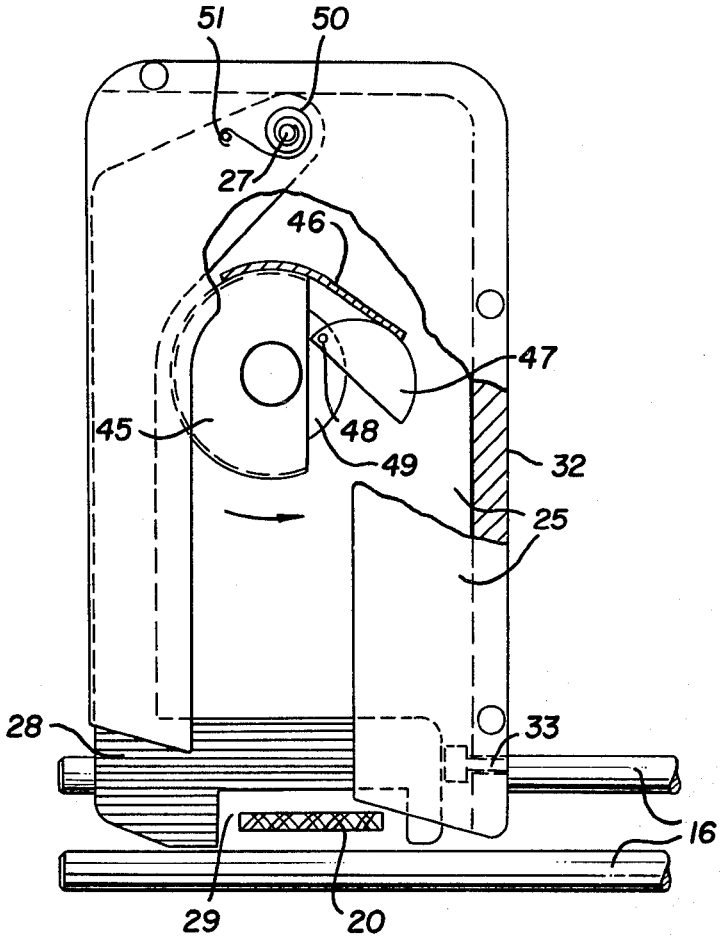
FIG. 8 shows a third embodiment of device for ejecting a slat, in the position of rest of the pivotting arm.
Figure 9:
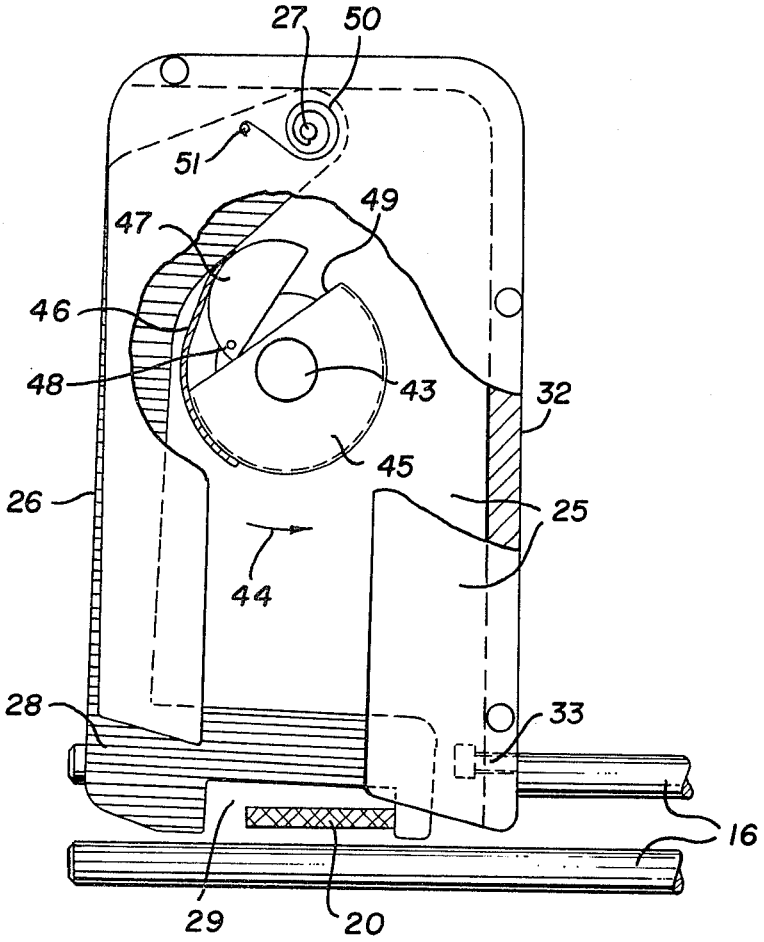
FIG. 9 shows the device of FIG. 8 at the moment of contact between the pivotting arm and the slat.
Figure 10:
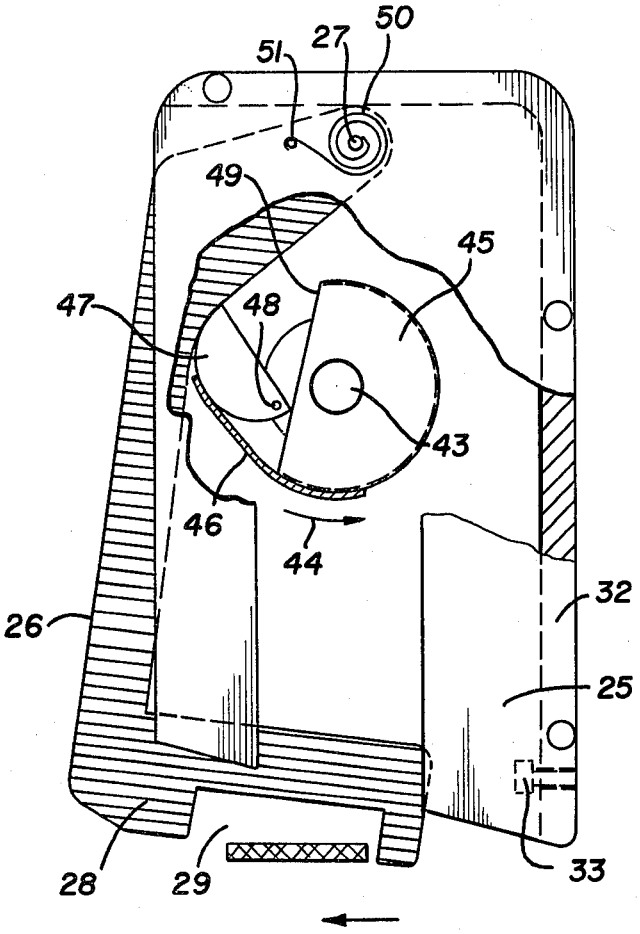
FIG. 10 shows the device according to FIGS. 8 and 9 during the ejection of a slat.

In a third embodiment shown in FIGS. 8 to 10, in which like parts are again indicated by like numerals, the drive shaft here shown at 43 is provided to rotate, in contrast to the embodiments described previously, in an anti-clockwise direction, as indicated by the arrow 44. A bearing body in the form of a disc 45 is rotatable with the drive shaft 43 and carries on its periphery a flat tension spring 46 fixed to it at one end. The disc 45 is circular with a cut out peripheral portion having an edge 49. A stop body 47 in the form of a segment of a circle is arranged to be rotatable about an axis 48 which is on the bearing body and eccentric to the shaft axis. The spring 46 is fastened at its other end, where it is approximately tangential to the periphery of the stop body 47; the fastening point lying on a larger eccentric radius relative to the shaft axis than the axis 48. That side of the stop body 47 which forms the chord of the circular segment can, in the case of maximum tensioning of the spring 46, come to rest against the edge 49. In this embodiment, the spring 46 tends to hold the stop body 47 in an outward condition. During rotation of the shaft 43, the stop body 47 contacts the inner face of the pivotting arm 26. The spring 46 extends initially, preventing abrupt movement of the arm 26, and later on releases its stored energy to accelerate the arm.

Provided in this embodiment also is an alternative form of restoring spring, shown at 50 and in the form of a spiral spring concentric with the pivot axis 27. The outer end of the restoring spring 50 is connected to the pivotting arm 26 at a point 51.

In selecting the axis of rotation 48 for the stop body 47 it can generally be assumed that the moment when the slat 20 is released by the stamping tool is always a particular moment within a work cycle. The angular position of the axis 48 on the disc 45 and the disc 45 on the shaft 43 must be selected accordingly. The moment at which the movement of the pivotting arm 26 begins will also depend on the form and position of the faces on the pivotting arm 26 and on the stop body 47, which contact one another.

Moreover, there are several possibilities in all embodiments described for arranging the individual parts of the cycle of movement. For instance in respect of the embodiment just described, when the pivotting arm 26 comes in contact with the slat 20 according to the illustration of FIG. 9, the slat 20 can still be held firmly by the stamping tool. As a result of further rotation of the pivotting arm 26, the spring 46 is tensioned to a greater extent, so that the acceleration force exerted on the slat 20 when it is released is increased correspondingly.

Independently of this, the movement can, for the period of time before the contact of the pivotting arm 26 with the slat 20, be predetermined so that the movement of the pivotting arm 26 begins immediately upon contact with the stop body 47, or alternatively somewhat thereafter and after the counter-acting turning moment of the restoring spring 50 has already been equalled and the spring 46 has already been partially tensioned to achieve this.

On the other hand, however, it is not absolutely necessary for the movement of the pivotting arm 26 to be temporarily stopped on contact with the slat 20. At the moment of contact, the slat 20 can already have been released by the stamping device, so that the pivotting arm 26 can continue its movement and acceleration upon contact with the slat 20.

Although in all embodiments described above it is the case that the drive shaft for the stamping and cutting stations controls the ejection devices, a separate shaft could if desired be provided for this purpose.

I claim:

1. In or for apparatus for making slats for a slatted blind, such apparatus including a discharge table to receive strip material and stamping and cutting stations associated with said discharge table, a device for ejecting finished slats from said discharge table, said ejecting device comprising in combination an arm pivotable about an axis transverse to the intended direction of ejection, said arm being adapted to engage a finished slat, and an acuating member to rotate with a rotating shaft and, in part of its cycle of rotation to engage said arm and urge said arm in said intended direction of ejection, said actuating member including resilient means through which it engages said arm and being adapted to provide sufficiently low initial acceleration of said arm in said direction to prevent damage to said slats.

2. A device as claimed in claim 1, wherein said actuating member comprises a resilient actuating lever which is connected at one end to one of said shaft and a disc mounted on said shaft and is substantially tangential adjacent said end, to the one of said shaft and said disc.

3. A device as claimed in claim 1, wherein said actuating member comprises a cam on said shaft, a stop part in said cam and movable radially herein with respect to said shaft, and a spring urging said stop part radially outwardly.

4. A device as claimed in claim 1, wherein said actuating member comprises a bearing body on said shaft, a stop body pivotally mounted on said bearing body on an axis eccentric to said shaft, and a spring urging said stop body to a radially outward rotational position relative to said bearing body.

5. A device as claimed in claim 4, wherein said spring is a tension spring attached at respective ends to peripheries said stop body and said bearing body, the point of the attachment of said spring to said stop body being radially outward of said eccentric axis relative to said shaft.

6. A device as claimed in claim 5, wherein said stop body has the form of a segment of a circle and said spring extends approximately tangentially to the peripheries of said bearing body and stop body.

7. A device as claimed in claim 4, wherein the bearing body has a recess where the stop body is supported and an edge limiting rotation of the stop body in an inward direction.

8. In or for apparatus for making slats for a slatted blind, such apparatus including a discharge table to receive strip material and stamping and cutting stations associated with said discharge table, a device for ejecting finished slats from said discharge table, said ejecting device comprising in combination an arm having a concavely curved edge and being pivotable about an axis transverse to the intended direction of ejection, said arm being adapted to engage a finished slat, an actuating member to rotate with a rotating shaft and, in part of its cycle of rotation to engage said edge and urge said arm in said intended direction of ejection, said actuating member being adapted to provide sufficiently low initial acceleration of said arm in said direction to prevent damage to said slats, a restoring spring acting on said pivotable arm in a direction opposite to the direction in which said actuating member is effective, and a stop effective to limit rotation due to the said restoring spring.

9. In or for apparatus for making slats for a slatted blind, such apparatus including a discharge table to receive strip material and stamping and cutting stations associated with said discharge table, a device for ejecting finished slats from said discharge table, said ejecting device comprising in combination an arm pivotable about an axis transverse to the intended direction of ejection, said arm being adapted to engage a finished slat, and an actuating member to rotate with a rotating shaft and, in part of its cycle of rotation to engage said arm and urge said arm in said intended direction of ejection, said acutating member being adapted to provide sufficiently low initial acceleration of said arm in said direction to prevent damage to said slats and said rotating shaft being a drive shaft of said apparatus for driving said stamping and cutting stations and being parallel to said axis of pivot of said pivotable arm.

10. A device as claimed in claim 9, wherein said drive shaft is below said axis of pivot of said pivotable arm, said pivotable arm extending downwards past said drive shaft to a position in which a finished slat is located and having a recessed lower position extending substantially horizontally when not displaced by said actuating member to engage a finished slat.

* * * * *